United States Patent [19]

Moore, Jr.

[11] 4,421,089

[45] Dec. 20, 1983

[54] FUEL METERING APPARATUS

[75] Inventor: Robert G. Moore, Jr., South Bend, Ind.

[73] Assignee: The Bendix Corporation, Southfield, Mich.

[21] Appl. No.: 399,515

[22] Filed: Jul. 19, 1982

[51] Int. Cl.[3] ..... F02D 1/04; F02M 39/00

[52] U.S. Cl. ..... 123/454; 123/455; 123/458; 123/459

[58] Field of Search ..... 123/454, 455, 459, 434, 123/488, 438, 440, 458

[56] References Cited

U.S. PATENT DOCUMENTS

| | | | |
|---|---|---|---|
| 3,999,527 | 12/1976 | Wessel et al. | 123/454 |
| 4,075,995 | 2/1978 | Krämer | 123/454 |
| 4,161,933 | 7/1979 | Stumpp | 123/454 |
| 4,207,849 | 6/1980 | Sumiyoshi et al. | 123/458 |
| 4,228,777 | 10/1980 | Haase | 123/454 |
| 4,294,213 | 10/1981 | Sumiyoshi et al. | 123/454 |
| 4,364,361 | 12/1982 | Eckert | 123/454 |

*Primary Examiner*—Raymond A. Nelli

*Attorney, Agent, or Firm*—William A. Marvin; Ken C. Decker

[57] ABSTRACT

A fuel/air ratio control apparatus for a reciprocating engine used in light aircraft including a fuel metering apparatus (32) and an electronic fuel/air ratio control (39). The control (39) generates an electrical signal (Wf/Wa) indicative of a desired fuel/air ratio based upon the flight condition of the aircraft and the metering apparatus (32) meters fuel flow (Wf) according to the mass airflow (Wa) ingested by the engine. The fuel metering apparatus (32) positions a metering valve (348) by means of a force balance of opposing forces developed by an air diaphragm (330) and a fuel diaphragm (336). The fuel diaphragm (336) is subjected to the differential pressure of a metering head pressure (Pu) and a fuel output pressure (Pm). The output pressure (Pm) is regulated by a controlled orifice (343) influenced by a proportional solenoid (406) whose armature valve (341) is positioned by the electrical signal (Wf/Wa).

10 Claims, 2 Drawing Figures

FUEL METERING APPARATUS

The invention pertains generally to a fuel metering apparatus and is more particularly directed to a hydromechanical metering apparatus regulated by an electronic control signal indicative of a commanded fuel/air ratio.

U. S. Pat. No. 3,926,162, commonly assigned with the present invention, illustrates a hydromechanical fuel metering apparatus advantageously used in regulating fuel flow to a reciprocating engine for a light aircraft. This apparatus is designed to control fuel flow by means of an input force generated by an air pressure responsive diaphragm and an opposing force generated by a fuel pressure responsive diaphragm. These forces are imposed on a rod-actuated fuel valve to meter fuel flow to the engine as a function of the mass air flow to the engine.

The apparatus is further shown to advantage in a paper entitled "Fuel System Requirements for Light Aircraft Turbocharged Reciprocating Engines" published by the Society of Automotive Engineers in April in 1974 for T. M. Kirwin and E. A. Hasse.

The force developed by the fuel diaphragm is the result of the differential fuel pressure produced by taking a pressure drop across a jetting system from a metering head pressure. The lower pressure or metered pressure can then be regulated by the jetting system to provide an automatic schedule of fuel/air ratios. The jetting system generally consists of a cruise jet used to establish the low power F/A ratio which is open all the time and a parallel enrichment jet which establishes the richest F/A ratio. In addition, for the special condition of idle, the apparatus includes an idle valve which is throttle actuated. Serially connected between the head pressure and automatic schedule jets is a manual mixture control valve to select a fuel cutoff operation, a full rich condition, or to override manually the automatic schedule.

In this apparatus, the automatic open loop fuel/air ratio schedule provided by the jetting system cannot provide the most optimum fuel/air ratio schedule for all differing conditons of aircraft operation and hence the necessity to trim or override the schedule with the manual mixture control. Additionally, as the engine ages, the open loop schedule provided by the jetting system will vary from its original operating point and the engine will not be operated in the most efficient manner.

SUMMARY OF THE INVENTION

The invention is an improvement to the fuel metering apparatus described above which provides a fuel metering apparatus more versatile in use because of its provision for adaptive or closed loop control of fuel/air ratio.

The fuel metering apparatus comprises means for generating a force proportional to the mass airflow being ingested into the engine, means for generating a force proportional to a fuel pressure differential where the differential is generated by a pressure drop across a first orifice and second orifice in parallel, means for varying the cross-sectional area of at least one of orifices in response to an electrical signal indicative of a desired fuel/air ratio, means for metering the fuel at the lower pressure which is positioned in response to the balance of the first force against the second force; and means for generating the electrical signal as a function of at least one operating parameter of the engine indicative of the actual fuel/air ratio.

In the preferred embodiment, the means for generating the electrical signal is an electronic control which regulates fuel/air ratio according to a closed loop control. The closed loop control can be based upon differencing a commanded fuel/air ratio value with the actual fuel/air ratio and regulating the area varying means in a direction to null the error. The actual fuel/air ratio may be either measured directly or derived from one of the operating parameters of the engine. Some operating parameters from which one can infer the actual fuel/air ratio of the engine are the cylinder head temperature and the exhaust gas temperature as is more fully discussed in the referenced Kirwin and Hasse article.

The electrical signal from the electronic control in the implementation shown positions the armature valve of a proportional solenoid to vary the cross-sectional area of either the first or second restriction. Since the restrictions are in parallel, the sum of both areas will provide the richest fuel/air ratio when the valve is positioned to open the controlled restriction and the leanest fuel/air ratio when the valve is positioned to close the controlled restriction. Between these two positions is an infinite number of fuel/air ratios based upon the position of the solenoid valve and controllable by the electrical signal.

Advantageously, when the electrical signal is absent, the apparatus fails to a safe operation where both restrictions are open. In this regard, a manual mixture control is provided in series with the two parallel restrictions to provide lean-out control when a full rich condition occurs because of the loss of the electrical signal, or otherwise. The manual mixture control is further used as total restriction on fuel flow to provide a cut-off operation.

Additionally, for idle conditions, the proportional solenoid is retained in a full rich position and an idle valve mechanically linked to the throttle linkage restricts the uncontrolled orifice to provide an idle mixture setting.

These and other objects, features, and aspects of the invention will be more clearly understood and better described if a reading of the detailed description is undertaken in conjunction with the appended drawings, wherein:

DETAILED DESCRIPTION OF THE PREFERRED EMBODIMENT

Figure 1:
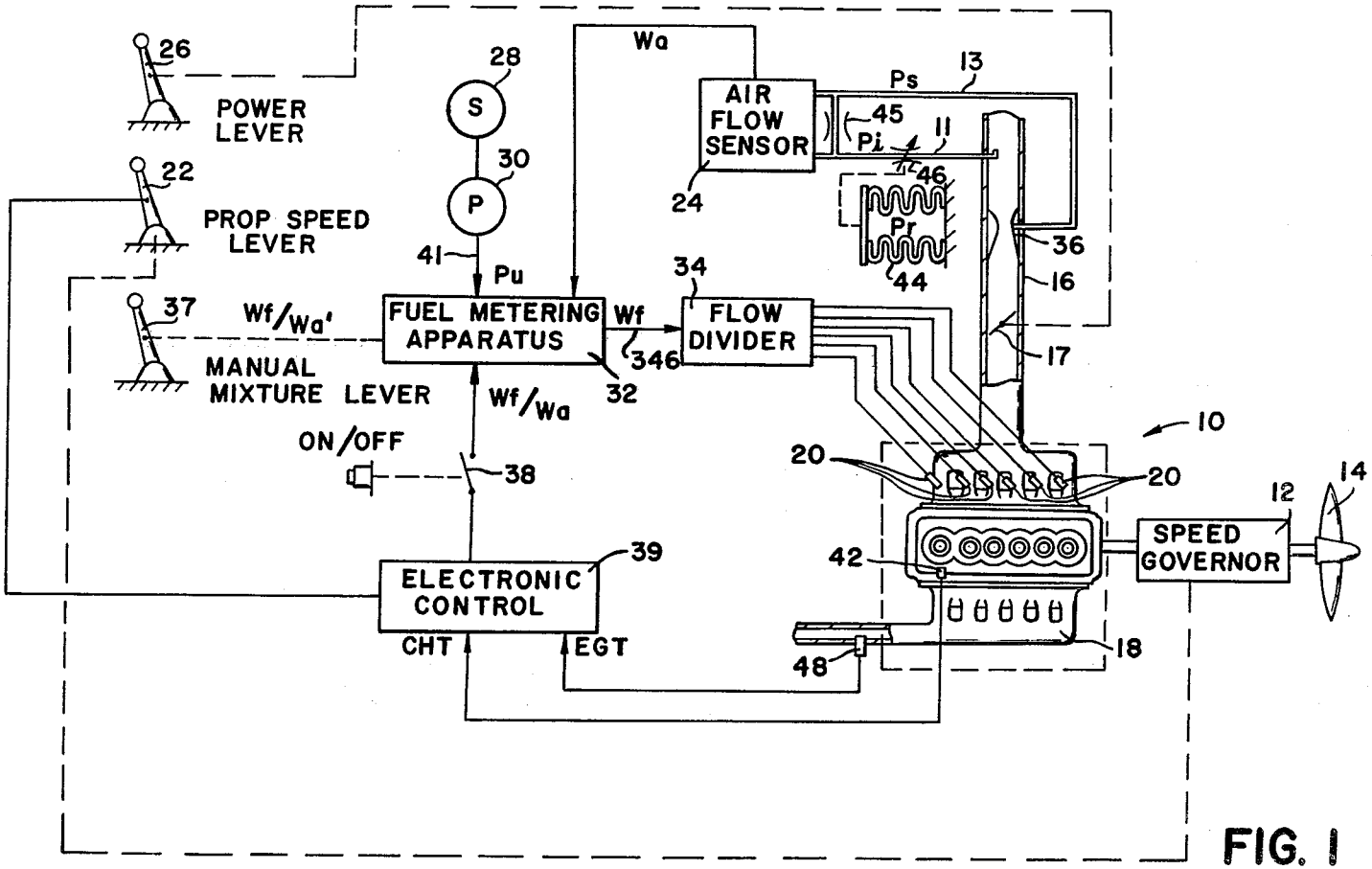
FIG. 1 is a system block diagram of a fuel/air ratio control apparatus for a reciprocating aircraft engine constructed in accordance with the teachings of the invention.

With attention now directed to FIG. 1 there is shown a fuel/air ratio control apparatus for a reciprocating aircraft engine 10 constructed in accordance with the teachings of the invention. The engine 10, as is conventionally known, comprises an intake manifold 16 which supplies air to the engine cylinders. The air which is mixed with fuel from fuel injector nozzles 20 enters the engine during an intake cycle. The fuel/air mixture is thereafter combusted in the individual cylinders of the engine 10 and exhausted through an exhaust manifold 18 to the atmosphere.

The engine through a speed governor 12 powers a variable pitch propeller 14 producing thrust to fly the aircraft. Thrust is varied by the pilot operating a prop speed lever 22 which changes the reference or set point of the speed governor 12 and the engine power lever 26. The speed governor regulates the speed of the prop 14 to the set point by varying the pitch of the propeller blade. The power output from the engine is controlled conventionally by a butterfly-type throttle plate 17 whose angle and hence cross-sectional area is controlled by a power lever 26. By coordinating the power lever 26 and the prop speed lever 22, the pilot can produce a number of power and speed outputs from the engine-propeller combination that are advantageous to the particular flight conditions desired.

To calculate the most advantageous fuel/air ratio for the engine during differing flight conditions, an automatic fuel/air ratio control apparatus including an electronic control 39 and a fuel metering apparatus 32 is provided. The fuel metering apparatus 32 receives fuel from a source 28 such as a wing tank which is pressurized with a pump 30 to provide a substantially constant fuel pressure Pu. This pressurized fuel is input to the fuel metering apparatus 32 which receives as another input an electronic signal from the electronic control 39 which is indicative of a desired fuel/air ratio (Wf/Wa). A third input to the fuel metering apparatus 32 is from an air flow sensor 34 which measures the amount of airflow, Wa, being ingested into the engine.

In this particular case the airflow sensor is shown as a differential pressure measurement apparatus which differences an impact pressure, Pi, formed at the inlet of the throat of the input manifold 16 and a static pressure, Ps, formed at a port of a venturi 36. The difference of these two pressures Ps-Pi is a function of the airflow being drawn into the engine past the throttle plate 17. Further, a variable bleed 46 may be positioned by its attachment to a bellows apparatus 44 scaled to a reference pressure Pr. The bellows 44 varies the area of the bleed opening with respect to ambient pressure and temperature to provide air density compensation. Thus, the airflow sensor produces a differential pressure Ps-Pi which is a function of the engine mass airflow.

From the three inputs, the fuel metering apparatus 32 provides a fuel flow, Wf, by metering the pressurized fuel input Pu in accordance with the multiplication of the desired fuel/air ratio, Wf/Wa, times the actual airflow, Wa. The gross metered fuel flow, Wf, for the entire engine is thereafter received by a flow divider 34 which in conjunction with the injector fuel nozzles 20, separates the overall flow into relatively equivalent amounts such that each injector 20 inputs the correct fuel/air ratio to the individual cylinders of engine 10. The fuel metering apparatus 32, as will be more fully explained hereinafter, is preferably a hydromechanical fuel metering device with an electronic trim being controlled by the electrical signal Wf/Wa. Further, although the invention is described as being particularly adapted to fuel injected engines, it should be evident that the gross fuel flow, Wf, could just as easily be input to an atomizing device of a pressurized carburetor or the like.

The fuel metering apparatus 32, although automatically controlled by the primary fuel/air ratio signal Wf/Wa, may also be controlled by a manual mixture lever 37, which the pilot can rotate to control a secondary fuel/air ratio signal Wf/Wa'. The manual mixture lever 37 may be used as a backup system to control the F/A ratio in exigent circumstances because of failure of the electronic fuel/air ratio controller or even as a preference. To this extent, the electronic fuel/air ratio controller 40 may be disconnected by an on/off switch 38 breaking the circuit from the controller to the fuel metering apparatus 32 which establishes the maximum F/A ratio.

The fuel/air ratio controller has an electronic control 39 which schedules the fuel/air ratio signal, Wf/Wa, as a function of at least one of the operating parameters of the engine. Preferably, the electronic control 39 operates a closed loop such that a scheduled parameter representing a desired fuel/air ratio is differenced with an actual fuel/air ratio representation and the error used to schedule the electrical signal Wf/Wa to the metering apparatus 32.

The actual fuel/air ratio may be either measured directly or derived from one of the operating parameters of the engine. Some of the operating parameters from which one can infer the actual fuel/air ratio of the engine are the cylinder head temperature (CHT) and the exhaust gas temperature (EGT) and is more fully discussed in the referenced Kirwin and Hasse article. The desired or scheduled fuel/air ratio parameter can be calculated in many ways but for the implementation shown is derived from the position of the prop speed lever as a signal PSS. From these three parameters PSS, CHT, and EGT, a closed loop control law can be developed to ouput the primary fuel/air ratio signal Wf/Wa.

The cylinder head temperature, CHT, is developed by a temperature sensor 42 such as a thermocouple located in intimate contact with the head of at least one cylinder of the engine 10. Particularly, cylinder head temperature is a limiting parameter which will cause damage to the engine if it is exceeded for any period of time. Therefore, the temperature sensor 42 is positioned to read the cylinder temperature of the engine that usually exhibits the hottest temperature for the particular aircraft. In tightly cowled aircraft the hottest cylinder is generally the one furtherest from the air intake or the last of an in-line engine as shown. Alternatively, for the control shown all cylinder heads could have a temperature probe and the highest reading selected as the input parameter CHT.

The exhaust gas temperature EGT is measured by as temperature sensor 48 such as a thermocouple located in the exhaust manifold 18 at a position to sample the composite exhaust gases of all cylinders. In this manner the temperature sensor 48 averages the exhaust gas temperature of all cylinders and produces the input parameter EGT as a measurement thereof. Again, as an alternative, it is well within the skill of the art to provide each cylinder with exhaust temperaure sensor and select the highest cylinder exhaust temperature as the input parameter EGT to the fuel air/ratio control 39.

The fuel/air ratio control 39 can schedule the fuel/air ratio signal Wf/Wa as a function of either CHT or EGT or a combination of both, according to a mode selection based upon flight condition. For the electronic control illustrated, the pilot indication of the desired flight condition and hence desired fuel/air ratio is generated by the signal PSS which corresponds to the position of the propeller speed lever 22.

An electronic control based upon the closed loop scheduling of fuel/air ratio for EGT and CHT of the type described is more fully disclosed in a copending U.S. application No. 140-81-030-0, entitled "FUEL-/AIR RATIO CONTROL APPARATUS FOR A RECIPROCATING AIRCRAFT ENGINE" filed in the name of Robert G. Moore, Jr., and which is commonly assigned with the present application. The disclosure of Moore is hereby expressly incorporated by reference herein. However, it will be evident that other closed loop electronic controls based on an operating parameter of the engine indicative of fuel/air ratio can be used to generate the signal WF/Wa. It is intended by the invention to include all such equivalent electronic controls.

Figure 2:
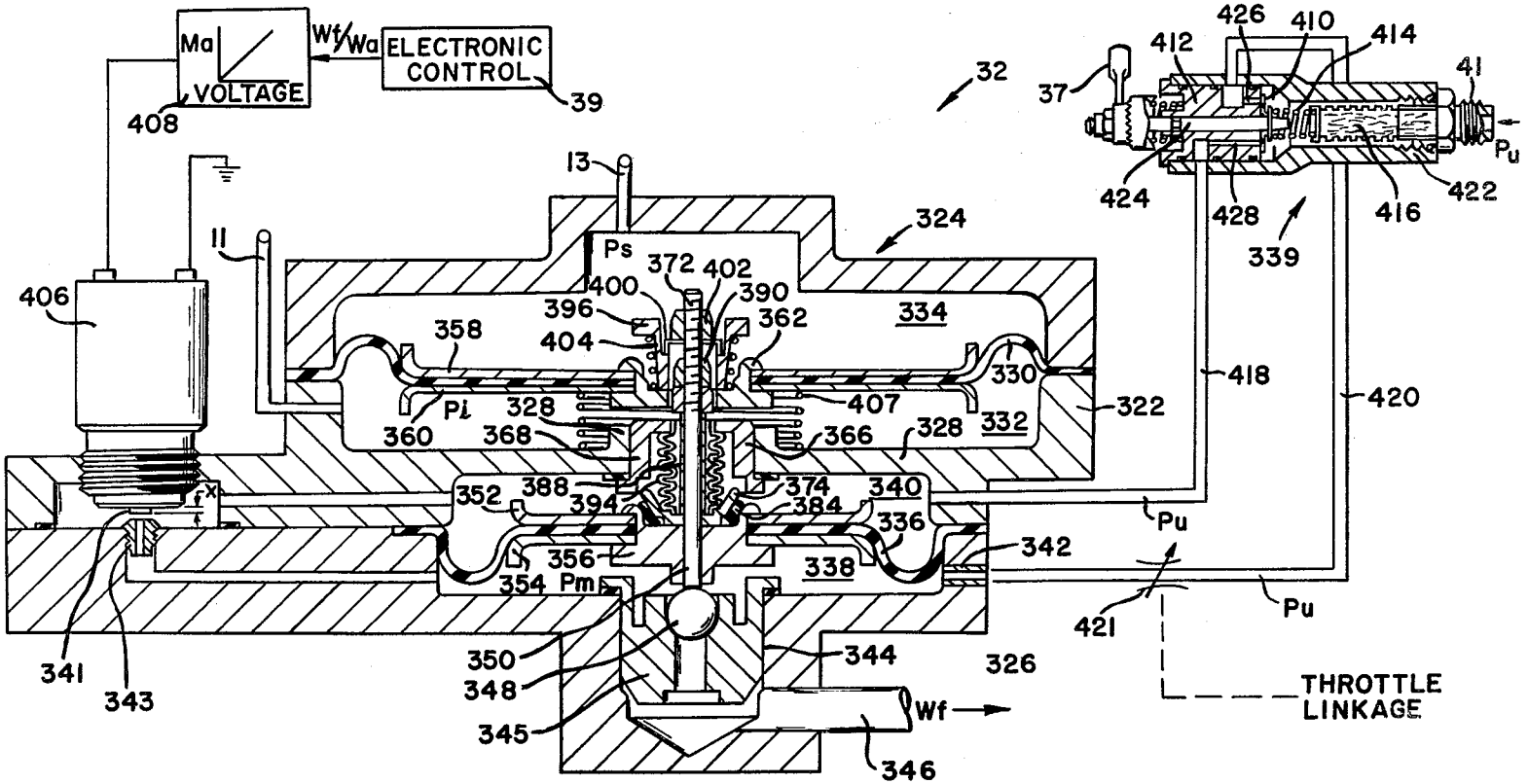
FIG. 2 is a detailed cross-sectional side view of the fuel metering apparatus for the fuel/air ratio control illustrated in FIG. 1.

Referring now to FIG. 2 the fuel metering apparatus 32 will now be described in further detail. In general, the fuel metering apparatus 32 shown includes a multi-section casing 322 having an air section 324 and a fuel section 326 separated by a wall 328. The air section 324 includes a diaphragm 330 fixedly secured in its outermost portion to casing 322 and separating a chamber 332 from a chamber 334. Chambers 334 and 332 are vented to the venturi static air pressure, Ps, and venturi impact air pressure, Pi, by conduits 11 and 13, respectively.

The fuel section 326 includes a diaphragm 336 fixedly secured at its outermost portion to casing 322 and separating a chamber 338 from a chamber 340. Chambers 338 and 340 communicate with pressurized fuel at pressures Pm and Pu, respectively, from the fuel supply conduit 41 after passing through a manual mixture, control, generally 339. Fuel pressures Pm and Pu are derived from the upstream and downstream sides respectively, of two parallel fuel metering orifices generally indicated at 342 and 343 disposed in a flow-controlling position for fuel section 326. The fuel pressure differential Pm-Pu across the metering orifices 342, 343 for a given effective cross-sectional area of the parallel orifices determines the rate of metered fuel flow.

Metering orifice 342 is fixed in area while the effective cross-sectional area of metering orifice 343 is controllable by the movement of a valve 341 forming the armature of a proportional solenoid 406. The valve 341 is movable in response to an electrical fuel/air ratio signal Wf/Wa through a distance X which allows the orifice 343 an infinitely variable cross-sectional area between fully open and fully closed. Preferably, the fuel/air ratio signal Wf/Wa is generated by the electronic control 39 as a voltage which can be coverted to a current by driver 408. The current from the driver 408 linearly regulates the positioning of the valve 341 with respect to orifice 343 and therefore pressure Pm.

While the means for varying the cross-sectional area of orifice 343 has been described as a proportional solenoid 406, various other means for accomplishing this function are available. There are a number of electrically controllable devices which may be used to position a valve with respect to an orifice such as a stepper motor, torque motor, or the like.

A manual mixture control 339 comprises a generally cylindrical member 412 mounted in a center bore of a tubular casing 422. Fuel under pressure Pu, from supply conduit 41 entering the bore of casing 422 is filtered by a filter 416 and then carried by internal passages 426, 428 of member 412 to conduits 418, 420. Rotatably adapted to vary the cross-sectional areas of the internal passages 426, 428 is a manual mixture valve 410 connected mechanically by pin 424 to manual mixture lever 37.

Rotation of the lever 37 to the automatic or full rich position opens passages 426,, 428 to where fuel metering is regulated by orifices 342, 343. However, the lever 37 may be rotated to vary the passage areas with valve 410 to lean out fuel/air ratio manually to any point desired. In the extreme full lean position valve 410 acts to block passages 426, 428 totally and operate as a fuel cutoff control.

The chamber 338 is provided with a fuel outlet defined by an annular valve seat 345 fixedly secured in an opening 344 of casing 322 by any suitable means such as a press fit. The opening 344, in turn, discharges fuel to a passage 346 which feeds fuel to the flow divider 34. The effective flow area of the valve seat 345 is controlled by the position of a ball valve 348 adapted to set thereon. The ball valve 348 is fixedly secured to one end of a rod or actuator stem 350 and is positioned relative to the valve seat 345 in response to a force balance derived from diaphragms 330 and 336.

The fuel diaphragm 336 is provided with backing plates 352 and 354 which are clamped against opposite sides thereof by retaining member 356 suitably upset or otherwise connected to provide a rigid assembly. The rod 350 is axially aligned with diaphragm 336 and extends through retaining member 356 which is fixedly secured to the rod 350 by any suitable means such as brazing or the like.

The air diaphragm 330 is provided with backing plates 358 and 360 clamped against opposite sides thereof by retaining member 362 suitably upset or otherwise connected to provide a rigid assembly. The rod 350 extends through an opening in a cup-shaped fitting 366 which in turn is fixedly secured in an opening 368 of wall 328 by any suitable means such as a press fit to provide a fluid seal between the fuel and air section. The rod 350 also extends through the center of opening 374 and retaining member 362 and is provided with a threaded portion 372.

A circular fitting 374 through which rod 350 extends is provided with a radially extending flange 388 the outermost portion of which is angled to define a stop portion engageable with fitting 366 to thereby limit axial travel of rod 350. The fitting 374 is adapted to seat against an annular flexible seal such as a conventional O-ring 384 contained by a recess of retaining member 356. The seal 384 is compressed between fitting 374 and retaining member 356 to provide a fluid seal therebetween.

The fitting 374 is urged against the seal 384 by a sleeve 388 slidably received on rod 350. The annular spacing member 390 slidably received on rod 350 bears against sleeve 388 and is secured in position axially by a lock nut threadedly secured on threaded portion 372. The spacing member 390 is received by an opening in retaining member 362 with sufficient clearance provided between the adjacent walls of spacing member 390 and retaining member 362 to allow slidable movement therebetween with a minimum of air leakage therethrough from chamber 334 to chamber 332.

A bellows 394 surrounding rod 350 is fixedly secured at opposite ends to fitting 366 and 374, respectively, by suitable means such as soldering or the like to provide a positive seal against fluid leakage between air and fuel on opposite sides. It will be understood that the bellows 394 is relatively small in diameter and formed of a suitable layer of thin metal to reduce to a minimum the spring rate of bellows 394. Therefore, it will be understood that the force involved in the compression of bellows 394 is minor may be neglected or easily compensated for. Limits to the compression and expansion of bellows 394 are established by engagement of the stop of fitting 374 with the fitting 366 or the seating of valve 348 against the seat 345, respectively. The mean effective area of bellows 394 is selected to be equal to the flow area of the valve seat 345 which results in the force derived from pressure Pm against the valve 348 and tending to seat the same being equalized by an opposing substantially equal force.

An annular spring retaining member 396 is provided having a central opening equivalent in diameter to that of the opening in retaining member 362. A cup-shaped member 400 slidably received by the rod 350 is arranged with its rim portion abutting annular retaining member 396. A lock nut 402 engaged with threaded portion 372 and bearing against cup-shaped member 400 retains cup-shaped member 400 and retaining member 396 bearing against the latter in position on rod 350. A compression spring 404 interposed between retaining member 396 and retaining member 362 provides a predetermined force preload tending to urge the same apart.

A compression spring 407 interposed between wall 328 and diaphgram 330 imposes a predetermined force preload on diaphragm 330 in opposition to compression spring 404. In general spring 406 serves to maintain a substantially constant preloading against diaphragm 330 which preload assist the pressure differential Pi-Ps across diaphragm 330 to thereby maintain a substantially constant linear relation between the fuel pressure differential Pu-Pm and the air pressure differential Pi-Ps at relatively low values of the latter.

The spring 404 is extended at low air flow when the air pressure differential Pi-Ps across diaphragm 30 is correspondingly low and results in retaining member 362 being biased against casing 322 which acts as a stop. The opposite end of spring 404 which bears against retaining member 396 serves to load stem 350 in a direction to open ball valve 348. The pressure differential Pu-Pm across diaphragm 336 required to balance the force of the spring 404 results in a constant fixed Pu-Pm pressure.

At low air flows or at idle conditions of the engine, the fuel/air mixture is controlled by allowing the solenoid 406 to remain open and restricting flow through orifice 342 with an idle valve 421 which is mechanically connected to the throttle linkage. After the throttle moves from an off idle position, the valve 421 becomes fully open and solenoid 406 sets the fuel/air ratio by positioning valve 341.

In operation, the pressure differential Pu-Pm generates a fuel flow proportional thereto and pressure differential Pi-Ps varies this fuel flow in concert with the mass airflow into the engine by balancing the forces on rod 350. Therefore, by varying the cross-sectional area of the controlled orifice 343 and hence pressure Pm, the output, Wf, will be a scheduled fuel/air ratio for any mass airflow.

When the orifice 343 is fully open, the device will provide the maximum or richest fuel/air ratio available from the apparatus. Conversely, when orifice 343 is completely closed by valve 341 the fuel/air ratio is controlled only by the area of orifice 342 and is the leanest available. Between these extremes is an infinitely variable range of fuel/air ratios which is determined by the electrical signal positioning the valve 341.

Preferably, the solenoid 406 positions valve 341 fully open when no current is applied from the driver 408 and positions the valve fully closed when maximum current is applied. This provides a failure mode for the electronic control that is fail-safe because if current is interrupted the fuel/air ratio level becomes full-rich. The engine mixture is still able to be controlled by the manual mixture control 339 which is then moved off of full rich or automatic to produce manual lean out.

While the preferred embodiments of the invention have been shown and described, it will be obvious to those skilled in the art that various modifications and variations may be made thereto without departing from the spirit and scope of the invention as hereinafter defined in the appended claims.

I claim:

1. A fuel control apparatus for a combustion engine having an intake manifold comprising:

means for generating a first force proportional to the mass air flow ingested into the engine;

means for generating a second foce proportional to a differential fuel pressure, wherein said differential fuel pressure is the difference between an input fuel pressure and an output fuel pressure and wherein said output fuel pressure is developed from said input fuel pressure by restricting the input fuel pressure across two parallel orifices;

a metering valve positioned in response to said first and second forces for metering fuel to said engine at said output pressure;

means for controlling the effective cross-sectional area of one of said restrictions in response to an electrical signal indicative of a desired fuel/air ratio for the engine; and means for generating said electrical signal from at least one operating parameter of the engine indicative of the actual fuel/air ratio of the engine.

2. A fuel control apparatus for a combustion engine as defined in claim 1, further including:

means, manually operated, for restricting said input fuel pressure prior to said first and second parallel orifices.

3. A fuel control apparatus for a combustion engine as defined in claim 1 further including:

an idle valve, actuated by the position of the throttle linkage, for restricting fuel flow to said uncontrolled orifice during engine idle conditions.

4. A fuel control apparatus for a combustion engine as defined in claim 1, wherein said first force generating means comprises:

an air diaphragm separating first and second air chambers communicating respectively, to first and second air pressures; said first force generating means generating the first force as a function of the pressure differential between said first and second air pressures.

5. A fuel control apparatus for a combustion engine as defined in claim 4, wherein:

said first pressure is the impact pressure of the throat of said intake manifold and said second pressure is the suction developed by a venturi located within the throat of said intake manifold above the throttle plate.

6. A fuel control apparatus for a combustion engine as defined in claim 5, wherein:

said first pressure is modified for density variations in the impact pressure of the throat of said intake manifold.

7. A fuel control apparatus for a combustion engine as defined in claim 1, wherein said second force generating means comprises:

a fuel diaphragm separating first and second fuel chambers communicating respectively to said input fuel pressure and said output fuel pressure; said second force generating means generating the second force as a function of the pressure differential between said input and said output fuel pressures.

8. A fuel control apparatus for a combustion engine as defined in claim 7, wherein said area controlling means comprises:

a proportional solenoid with a movable armature valve operable to fully open and fully close said controlled restriction.

9. A fuel control apparatus for a combustion engine as defined in claim 8, wherein:

in the absence of said electrical signal, said proportional solenoid positions the armature valve such that said controlled restriction is fully open.

10. A fuel control apparatus for a combustion engine as defined in claim 9, wherein:

in the presence of said electrical signal said proportional solenoid positions the armature valve as a function of current to where said controlled restriction can be fully closed.

* * * * *